United States Patent [19]

Arai

[11] Patent Number: 4,916,759

[45] Date of Patent: Apr. 17, 1990

[54] FULL FACE TYPE HELMET

[76] Inventor: Michio Arai, 1-164, Horinouchi, Ohmiya-shi, Saitama-ken, Japan

[21] Appl. No.: 355,995

[22] Filed: May 23, 1989

[51] Int. Cl.[4] ..... A42B 3/02

[52] U.S. Cl. ..... 2/414; 2/424

[58] Field of Search ..... 2/410, 411, 413, 414, 2/425, 6

[56] References Cited

U.S. PATENT DOCUMENTS 2,863,151 12/1958 Morgan ..... 2/414
4,044,399 8/1977 Morton ..... 2/414
4,282,610 8/1981 Steigerwald et al. ..... 2/414
4,698,856 10/1987 Arai ..... 2/425

*Primary Examiner*—Werner H. Schroeder
*Assistant Examiner*—Michael A. Neas
*Attorney, Agent, or Firm*—Klauber & Jackson

[57] ABSTRACT

A full face type helmet having a shock absorbing liner disposed throughout the entire inner surface of a cap and an inner pad mounted inside the shock absorbing liner. Right and left cheek pad portions each comprising integral portions of the shock absorbing liner and the inner pad are removable through elastic members.

8 Claims, 5 Drawing Sheets

FULL FACE TYPE HELMET

BACKGROUND OF THE INVENTION

1. Field of the Invention

The present invention relates to a full face helmet for the driver of a motorbike or an automobile and more particularly to a full face type helmet having removable cheek pad portions.

2. Prior Art

A full face helmet for protecting the head of a person on a motorbike or an automobile is composed of a cap obtained by molding of a material such as FRP (fiber glass reinforced plastic); a shock absorbing liner fitted inside the cap and formed of polystyrene foam or a material having shock absorbability equal to or even higher than that of polystyrene foam; a jaw guard formed of polystyrene foam or another suitable material, extending from the jaw portion in the cap to the right and left temple portions; inner pads such as side cushions attached to the inner surface of the shock absorbing liner; and a chin strap. Cheek pads to fill up the gap between the inner surface of the shock absorbing liner and the cheek portions are integrally fixed to the inner surface of the liner by bonding means.

In buying such full face type helmet, a suitable size is selected in conformity with the size of the head of the person about to buy the helmet, but the cheek portions are each covered with the portion to be crushed of the cushion material which constitutes each cheek pad. However, in case of a person having extremely hollow cheeks, there is formed a gap between each cheek pad and the cheek opposed thereto, resulting in that the person wearing the helmet takes patience without good fitness.

Further, the inner pads attached to the inner surface of the shock absorbing liner are stained, smell of sweat, and may become moldy in the rainy season, due to sweat and dust. But, since those inner pads are fixed, they cannot be washed.

Recently, to solve the above-mentioned problems, there have been developed helmets of the type having inner pads capable of being removed easily.

However, since they are constructed mainly for being removable:

(1) Their mounted state is not stable.

(2) Below the cheek pads there is no shock absorbing liner, or even when the liner is present, its thickness is smaller than that of a fixed type helmet so it is impossible to ensure a satisfactory protecting function and safeness.

SUMMARY OF THE INVENTION

The present invention has been accomplished in view of the above-mentioned problems of the prior art and it is an object thereof to provide a full face type helmet having cheek pads which permit easy choice of size and easy removal for washing while ensuring the same fitness and safeness as in the fixed type.

It is another object of the present invention to provide a full face type helmet capable of simplifying the work for mounting the shock absorbing liner into the gap.

According to technical means which the present invention adopted in order to achieve the abovementioned objects, the shock absorbing liner mounted inside the cap is divided into four portions which are a body portion including a head top part with an inner pad stuck onto the inner surface thereof, a jaw guard portion, and right and left cheek pad portions, the body portion and jaw guard portion being fixed to the inner surface of the cap to define concave portions for mounting therein of the cheek pad portions. An elastic member is attached to an end face of each cheek pad portion or to one of the end faces of the body portion and the jaw guard portion both defining the concave for each cheek pad portion at which end faces the body portion, and the jaw guard portion comes into abutment with the end face of each cheek pad portion. Each cheek pad portion is fitted in the said concave portion while pressing the elastic member and it is held in engagement with the concave portion by the elastic force of the elastic member acting in the direction parallel to the cap surface.

The mounting position of the elastic member for engaging and holding each cheek pad portion by its elastic force may be any of the front and rear ends of the cheek pad portion, a rear end face of the jaw guard portion, and a front end face of the body portion.

Further, each cheek pad portion and jaw guard portion or the body portion may be provided at the respective abutments with concave and convex members, or vice versa, respectively, for positioning.

The elastic member is not specially limited if only it can shrink longitudinally when stressed and can revert to the original length when the stress is removed. For example, an elastic sponge is not only effective for this purpose but also it has a safety factor. In the case where the elastic member is attached to each cheek pad portion and the shock absorbing liner of the cheek pad portion itself changes in its size longitudinally when stressed, it is not necessary to provide the elastic member.

According to the above construction, each cheek pad portion composed of the shock absorbing liner and the inner pad is fitted in the concave portion formed between the body portion fixed to the inner surface of the cap and the jaw guard portion, while pressing the elastic member attached to the front or rear end face of the cheek pad portion or a rear end face of the jaw guard portion or a front end face of the body portion which rear and front end faces are opposed to the front and rear end faces, respectively, of the cheek pad portion, whereby the cheek pad portion is held in engagement with the concave portion by the elastic force of the elastic member acting in the direction parallel to the cap surface.

The safeness and stability of the cheek pad portions are ensured because they are each provided with the shock absorbing liner as the base, like the body portion and the jaw guard portion.

BRIEF DESCRIPTION OF THE DRAWINGS

The accompanying drawings illustrate embodiments of the present invention, in which.

DESCRIPTION OF PREFERRED EMBODIMENTS

Embodiments of the present invention will be described hereinunder with reference to the accompanying drawings.

Figure 1:
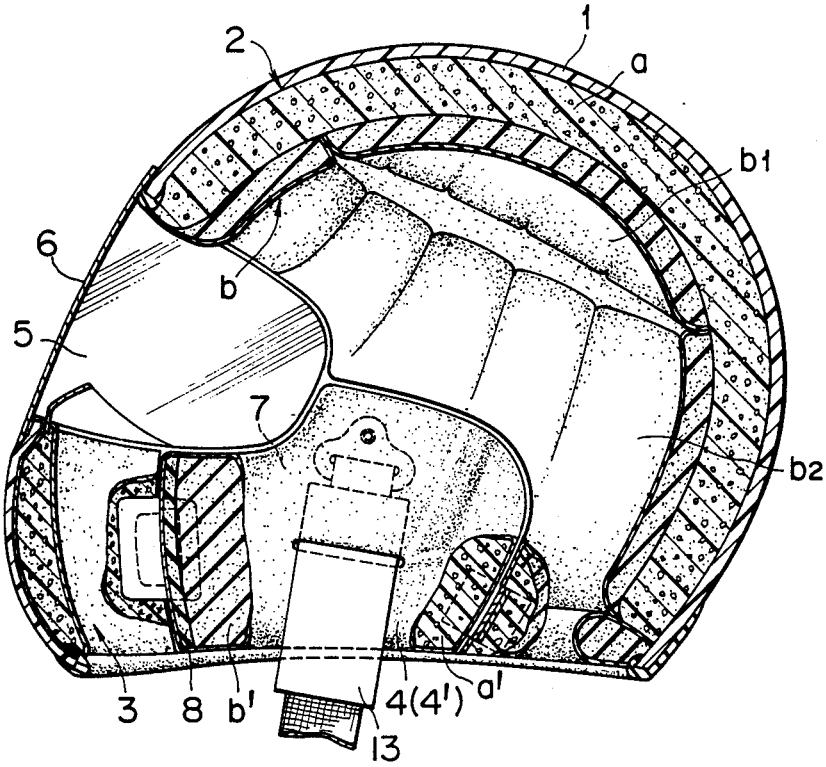
FIG. 1 is a side view in longitudinal section of a full face type helmet according to the present invention.
Figure 3:
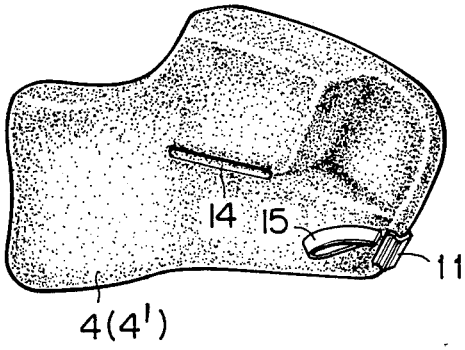
FIG. 3 is a perspective view of a cheek pad portions as seen from its rear face side.
Figure 2:
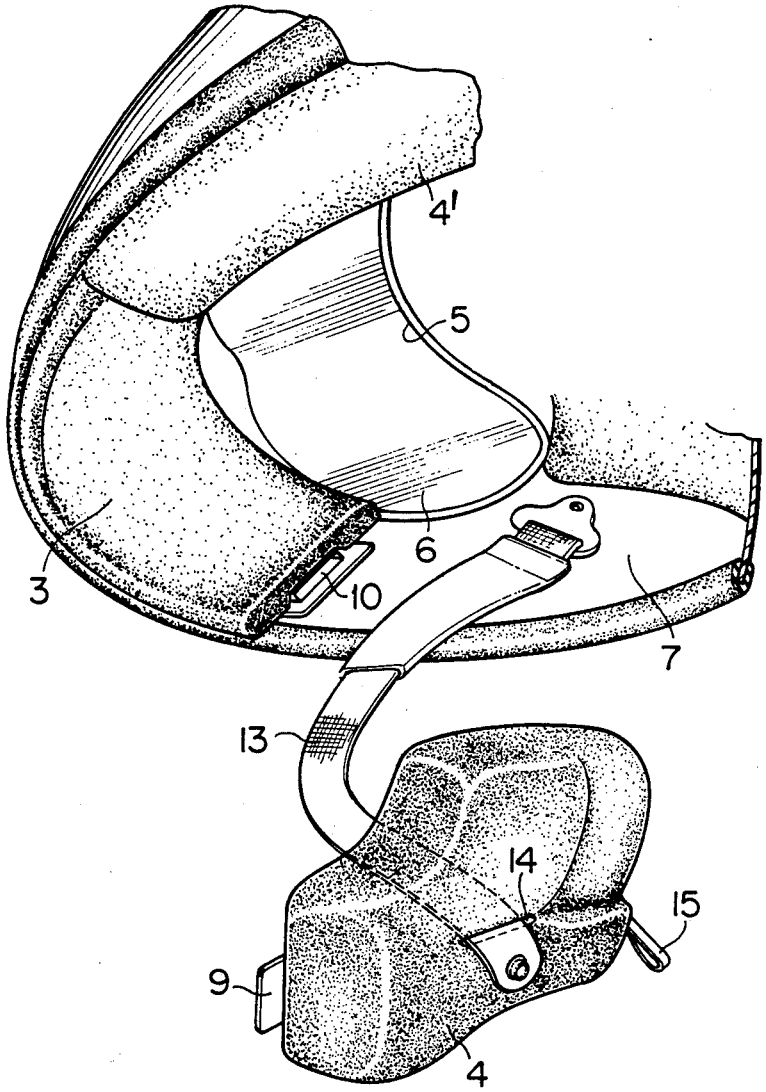
FIG. 2 is a perspective view with cheek pad portions removed.

FIG. 1 is a sectional view of a full face type helmet having a structure according to the present invention, in which the numeral 1 denotes a cap; numeral 2 denotes a body portion mounted in the cap 1; numeral 3 denotes a jaw guard portion; and numerals 4, 4' each denote a cheek pad portion.

The cap 1 is formed in a predetermined shape using such a material as FRP. In the front face thereof is formed a window opening 5 which is generally rectangular in front view to permit the eyes to be exposed, the window opening 5 being opened and closed by a transparent shield 6 which is attached pivotably to the outside of the cap 1.

The body portion 2, which is fitted and fixed to the inside of the cap 1 has a shock absorbing liner, a, formed in a shape including a head top part, using polystyrene foam or a material having shock absorbability equal to or even higher than that of polystyrene foam, and an inner pad, b, attached to the inner surface of the shock absorbing liner, a. The inner pad, b, has a head cushion $b_1$ and head band $b_2$. The inner pad, b, is obtained by covering a cushion material of good air permeability, e. g. a coarse netlike polyurethane foam, with a lining cloth which is agreeable to the touch and superior in air permeability. The lining cloth which comes into direct contact with the head is a special water-absorbing cloth of a dry touch capable of shifting sweat completely to the back of the cloth.

The jaw guard portion 3 is formed generally in U shape in plan to cover the portion from the jaws to just before the right and left cheek portions in the cap 1, using polystyrene foam or a material having shock absorbability equal to or even higher than that of polystyrene foam. To the surface portion which comes into contact with the jaws is bonded a surface material such as leather or a synthetic leather.

The body portion 2 and the jaw guard portion 3 are fitted and bonded to the inside of the cap 1 integrally through an adhesive, whereby there are formed concave portions 7 between the body portion 2 and the jaw guard portion 3 for the mounting therein of the cheek pad portions 4, 4'.

The cheek pad portions 4 and 4' are each an integral body comprising a shock absorbing liner a' having shock absorbability such as polystyrene foam and an inner pad b' obtained by covering a cushion material such as polyurethane foam with a lining cloth. To the front end face of each of the cheek pad portions 4, 4' is attached an elastic member 8.

The elastic members 8 are provided in a predetermined thickness on the front end faces of the shock absorbing liners a' of the cheek pad portions 4 and 4', and by the elastic forces of the elastic members the cheek pad portions 4 and 4' are engaged and held in the concave portions 7.

A tongue piece 9, which is a resin molded article, is fixed to a lower part of the front end of each of the cheek pad portions 4 and 4', and a receptacle portion 10 for the tongue piece 9 is formed in a lower part of each rear end face of the jaw guard portion 3. The rear end face of each of the cheek pad portions 4, 4' and the front end face of the body portion 2 are provided with a convex member 11 and a concave member 12, respectively, in a opposed relation to each other for positioning purpose.

Further, the cheek pad portions 4 and 4' are each formed with a slit 14 for insertion therein of a jaw band 13 which is riveted to each concave portion 7 on the inner surface of the cap 1, and a gripping strap 15 for removal of each of the cheek pad portions 4 and 4' which have been set in the concave portions 7 is attached to the side opposite to the mounted side of the tongue piece 9.

Figure 6:
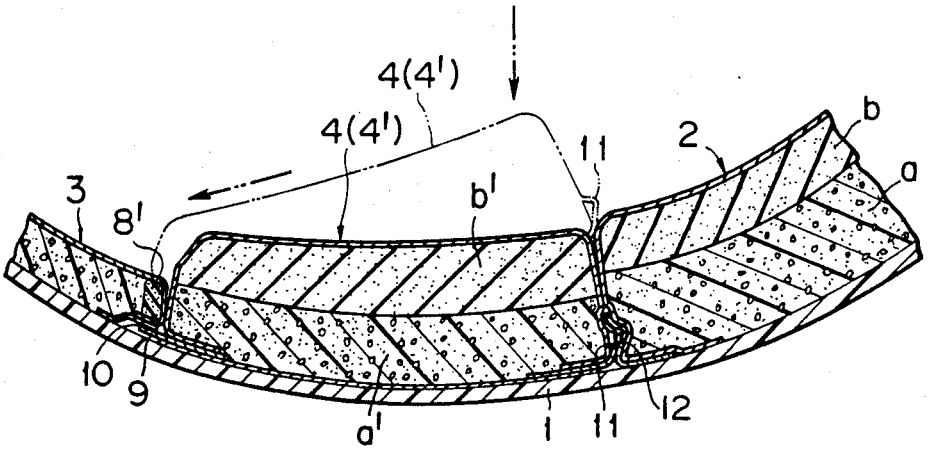
FIGS. 6 and 7 are sectional views showing modified examples of mounting of elastic members.
Figure 7:
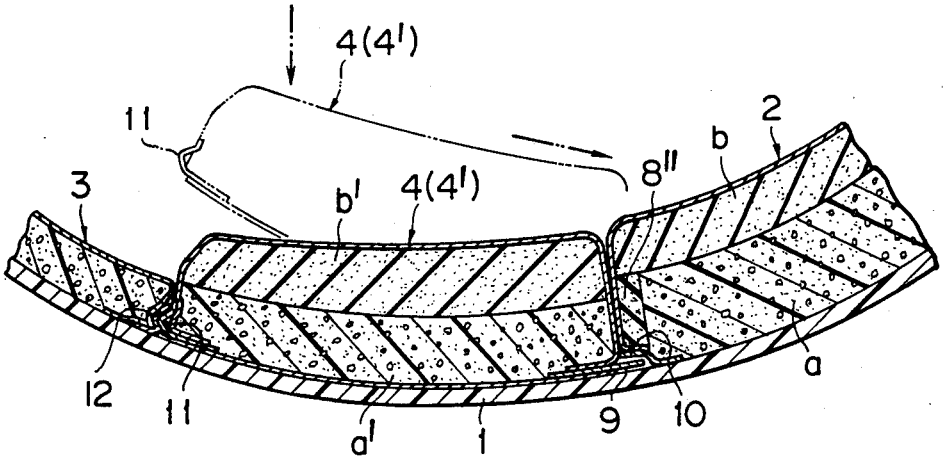

The elastic members 8 for holding the cheek pad portions 4 and 4' elastically in engagement with the concave portion 7 are not limited to the mode of being attached to the front end faces of the cheek pad portions. As shown in FIG. 6, an elastic member 8' may be attached to each rear end face of the jaw guard portion 3, or as shown in FIG. 7, an elastic member 8'' may be attached to each front end face of the body portion 2.

Figure 8:
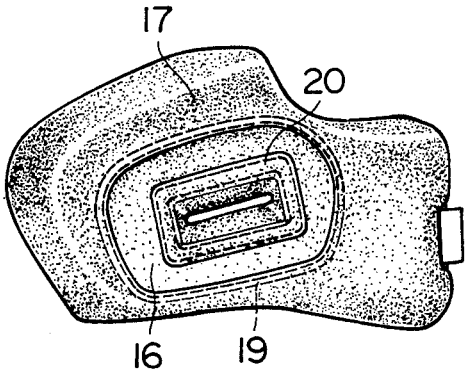
FIG. 8 is a rear perspective view of a cheek pad portion composed of a pad body and a removable surface cover.
Figure 9:
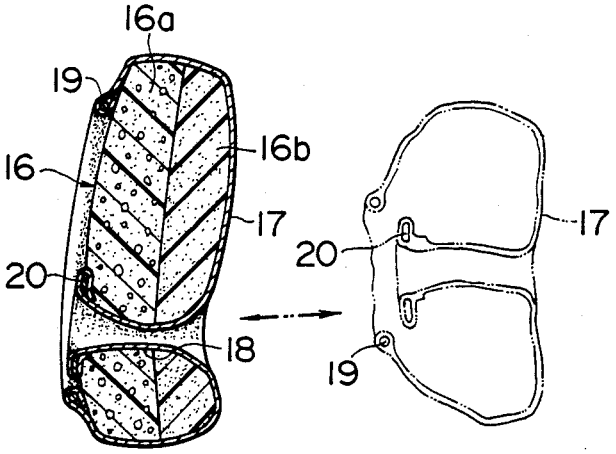
FIG. 9 is a vertical sectional view thereof.

FIGS. 8 and 9 show a modified example of a cheek pad portion, which is composed of a pad body 16 comprising a shock absorbing liner 16*a* having shock absorbability such as polystyrene foam and a cushion material 16*b* such as polyurethane foam, the liner 16*a* and the cushion material 16*b* being stuck together, and a surface cover 17 which is agreeable to the touch and has air permeability. The surface cover 17 is capable of being attached to and detached from the pad body 16.

In an approximately central position of the pad body 16 is formed a laterally long, through slit 18 for insertion therethrough of the jaw band 13.

A clamp rubber 19 is mounted in an outer peripheral edge of the surface cover 17, while to an inner peripheral edge of the cover is integrally fixed an annular plate 20 adapted to come into abutting engagement with the peripheral edge of the slit 18 of the pad body. The annular plate 20 has an opening for inserting therein of the jaw band 13.

Under the above construction, the annular plate 20 fixed to the inner peripheral edge of the surface cover 17 is passed through the slit 18 of the pad body 6 and brought into an abutting engagement with the back of the pad body 16, then the cover 17 is applied onto the surface of the pad body 16 while pulling its outer peripheral edge outwards, and the clamp rubber 19 is positioned on the peripheral edge of the back of the pad body 16, whereby the mounting with stretching of the surface cover 17 is completed.

Figure 4:
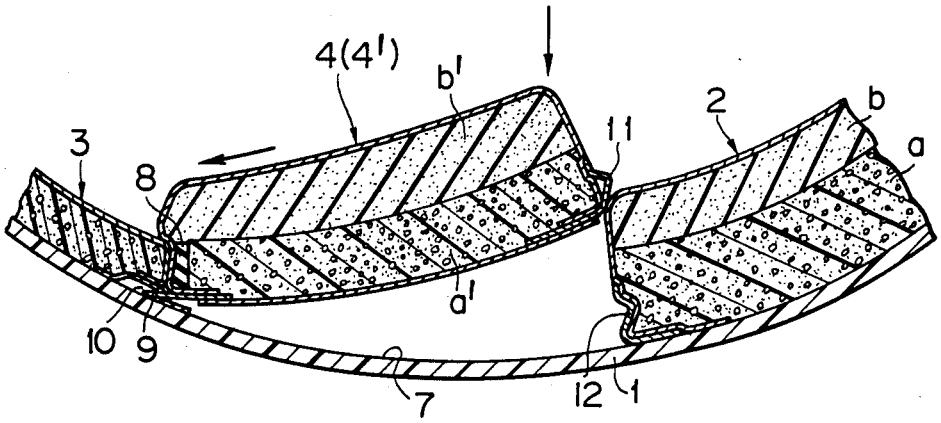
FIGS. 4 and 5 are partially enlarged sectional views showing in what state the cheek pad portion is fitted and mounted in a predetermined space.
Figure 5:
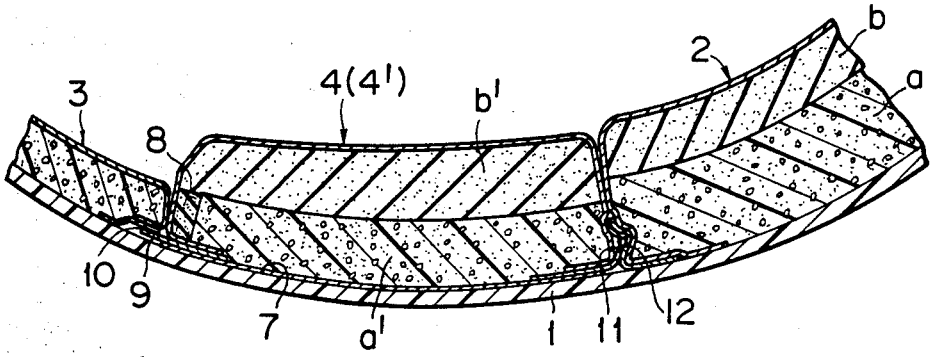

In the cheek pad portions 4 and 4' constructed as above, first the tongue pieces 9 fixed to lower positions of the front end faces of the cheek pad portion 4 and 4' are inserted into the receptacle portions 10 formed in lower positions of the rear end faces of the jaw guard portion 3, then the cheek pad portions 4 and 4' are fitted into the concave portions 7 while the elastic members 8 attached to the front end faces of the cheek pad portions are pressed against the rear end faces of the jaw guard portion 3 (see FIG. 4). The cheek pad portions 4 and 4' thus fitted in the concave portions 7 are urged in a direction to abut the front end faces of the body portion 2 by the elastic force of the elastic members 8 acting in the direction parallel to the surface of the cap 1, so that the convex and concave members 11, 12 are engaged with each other, whereby the cheek pad portions 4 and 4' are held firmly in the concave portions 7 (see FIG. 5).

Even without providing such engaging means as the tongue pieces 9 and the receptacle portions 10, also serving to effect positioning, as well as the convex and concave members 11, 12, the cheek pad portions 4 and 4' fitted in the concave portions 7 can be held more stably by inclining the front and rear end faces of the cheek pad portions 4 and 4' generally in a trapezoidal form.

Since the full face helmet of the present invention is constructed as described above in detail, the following effects can be attained.

(1) Since the cheek pad portions fitted in the concave portions each have a base formed of a material equivalent to the shock absorbing liner, and the cushion material is placed thereon, there can be provided a stable helmet free of wobbling of components (the cheek pad portions) while ensuring fitness and safeness to the same extent as in the type wherein each cheek pad portion is fixedly bonded to the inner surface of a shock absorbing liner continuous to a jaw guard portion.

(2) Since the cheek pad portions are removable, there can be provided a helmet wherein when gaps are formed between cheeks and the cheek pad portions at the time of selecting a suitable size, the cheek pad portions can be replaced with other cheek pad portions different in thickness of the cushion material, whereby there can be selected a helmet having cheek pad portions firmly fitted therein.

(3) The removable construction of the cheek pad portions permits them to be removed and washed when stained with sweat and dust, and it is also possible to make replacement between summer and winter seasons.

(4) Where concave and convex members for positioning in the mounting operation are provided in the cheek pad portions and the jaw guard portion or the body portion opposed thereto, it is possible to set the cheek pad portions in predetermined positions easily.

(5) Since the shock absorbing liner and the inner pad mounted in the cap are divided to the body portion, jaw guard portion, and the right and left cheek pad portions, the operation for mounting the shock absorbing liner portion into the cap can be done in a simple manner.

What is claimed is:

1. A full face type helmet including a cap, a shock absorbing liner disposed throughout the entire inner surface of the cap, and an inner pad mounted inwardly with respect to the shock absorbing liner, said shock absorbing liner being divided into four portions which are a body portion including a head top part with an inner pad adhered onto the inner surface thereof, a jaw guard portion, and right and left cheek pad portions, the body portion and the jaw guard portion being fixed to the inner surface of the cap to define concave portions for mounting therein of the cheek pad portions; an elastic member interposed between the cheek pad portions on one hand and one of the body portion and the jaw guard portion on the other hand; and each said cheek pad portion being fitted in each said concave portion while pressing said elastic members and being held removably in engagement with the concave portions by an elastic force of the elastic member acting in a direction parallel to the cap surface.

2. A full face type helmet according to claim 1, wherein said elastic member is attached to one end of each said cheek pad portion.

3. A full face type helmet according to claim 1, wherein said elastic member is attached to a rear end face of each said jaw guard portion.

4. A full face type helmet according to claim 1, wherein said elastic member is attached to a front end face of each said jaw guard portion.

5. A full face type helmet according to any of claims 1 to 4, wherein each said cheek pad portion is provided with one of a concave and convex member and at least one of said jaw guard portion and said body portion are provided with the other of said concave and convex members, respectively, at respective abutments therebetween.

6. A full face type helmet according to any of claims 1 to 4, further including a gripping strap for removal attached to each said cheek pad portion.

7. A full face type helmet according to claim 1, wherein each said cheek pad portion comprises a pad body and a surface cover which covers said pad body, said pad body being formed with a slit for insertion therein of a jaw band, a clamp rubber attached to an outer peripheral edge of said surface cover which covers the pad body, an annular plate fixed to an inner peripheral edge of the surface cover for abutting engagement with a back of said pad body along the peripheral edge of said slit, said annular plate being brought into engagement with the back of said pad body through said slit, and said clamp rubber being engaged with the back of the peripheral edge of the pad body.

8. A full face type helmet according to claim 5, further including a gripping strap for removal attached to each said cheek pad portion.

* * * * *